US006447228B1

(12) United States Patent
Fergusson

(10) Patent No.: US 6,447,228 B1
(45) Date of Patent: Sep. 10, 2002

(54) ROCK BOLT AND METHOD OF FORMING A ROCK BOLT

(75) Inventor: Jeffrey R. Fergusson, Glenorie (AU)

(73) Assignee: Industrial Roll Formers Pty Ltd., New South Wales (AU)

( * ) Notice: Subject to any disclaimer, the term of this patent is extended or adjusted under 35 U.S.C. 154(b) by 0 days.

(21) Appl. No.: 09/701,231

(22) PCT Filed: May 21, 1999

(86) PCT No.: PCT/AU99/00392

§ 371 (c)(1),
(2), (4) Date: Mar. 21, 2001

(87) PCT Pub. No.: WO00/36472

PCT Pub. Date: Jun. 22, 2000

(30) Foreign Application Priority Data

May 22, 1998 (AU) ..... PP3675

(51) Int. Cl.[7] ..... F16B 39/02
(52) U.S. Cl. ..... 411/82; 405/259.5
(58) Field of Search ..... 411/451.1, 451.2, 411/451.4, 452, 922, 75, 76, 82, 82.1–82.3; 405/259.5, 259.6

(56) References Cited

U.S. PATENT DOCUMENTS

| | | | | |
|---|---|---|---|---|
| 2,006,813 | A | * | 7/1935 | Norwood |
| 2,898,964 | A | * | 8/1959 | Masters |
| 3,021,745 | A | * | 2/1962 | Libom |
| 3,091,991 | A | * | 6/1963 | Baker |
| 3,108,443 | A | | 10/1963 | Schuermann et al. |
| 3,641,772 | A | | 2/1972 | Dietrich |
| 3,797,254 | A | | 3/1974 | Askey et al. |
| 3,859,889 | A | * | 1/1975 | Fischer |
| 4,127,000 | A | | 11/1978 | Montgomery, Jr. et al. |
| 4,343,399 | A | | 8/1982 | Patel et al. |
| 4,430,025 | A | | 2/1984 | Ciavatta |
| 4,432,682 | A | | 2/1984 | McKewan |
| 4,564,315 | A | | 1/1986 | Rozanc |
| 4,652,194 | A | | 3/1987 | Tajima et al. |
| 4,744,699 | A | | 5/1988 | Price et al. |
| 4,820,095 | A | | 4/1989 | Mraz |
| 4,850,746 | A | | 7/1989 | Finsterwalder et al. |
| 5,011,354 | A | * | 4/1991 | Brownlee |
| 5,054,146 | A | * | 10/1991 | Wiesenfld |
| 5,076,734 | A | * | 12/1991 | Hipkins |
| 5,273,377 | A | * | 12/1993 | Taylor |
| 5,387,060 | A | | 2/1995 | Locotos |
| 5,562,377 | A | | 10/1996 | Giannuzzi et al. |
| 6,033,153 | A | | 3/2000 | Fergusson |

FOREIGN PATENT DOCUMENTS

| | | |
|---|---|---|
| AU | A-38991/85 | 2/1985 |
| AU | A-25046/88 | 5/1989 |
| DE | 1902045 | 1/1969 |
| DE | 28 43 038 | 4/1980 |
| DE | 41 26 539 A1 | 2/1993 |
| FR | 2500053 | 2/1981 |
| GB | 2 172 682 | 3/1986 |
| GB | 2 206 172 | 6/1987 |
| GB | 2 211 259 | 10/1987 |
| GB | 2 211 260 | 10/1987 |

* cited by examiner

*Primary Examiner*—Flemming Saether
(74) *Attorney, Agent, or Firm*—Harness, Dickey & Pierce, P.L.C.

(57) ABSTRACT

Improvements to a rock bolt and a method of forming a rock bolt are disclosed. The rock bolt includes at least one paddle section that is formed by applying an eccentric shear force to the shank of the bolt from opposite sides of the bolt. The paddle section is thereby comprising an eccentrically deformed portion of the shank of the bolt. The rock bolt is adapted for use in a hold sized to receive the bolt with a clearance fit. A resin mixture contained in the hold is cooperable with the paddle section of the rock bolt to secure the bolt within the hole.

5 Claims, 3 Drawing Sheets

ROCK BOLT AND METHOD OF FORMING A ROCK BOLT

FIELD OF THE INVENTION

The present invention relates to a rock bolt and method of forming a rock bolt particularly but not exclusively, a rock bolt for use with a resin anchor.

BACKGROUND OF THE INVENTION

To install a rock bolt in a mine wall a hole is firstly drilled in the wall and a chemical or resin mixture inserted in the hole. The bolt may then be inserted and is preferably rotated during insertion to mix the resin. To enhance mixing, the bolt may be provided with suitable thread form. In the event the diameter of the hole is greater than desired, a mixing device, such as a wire spirally wrapped along the length of the bolt may be provided. Alternatively, a paddle section may be provided by stamping the bolt.

A disadvantage associated with forming the paddle section is that substantive compressive load needs to be applied and the resultant stresses plastically deform the bolt axially as well as sidewardly of the bolt. The sideward displacement of material in the bolt is minimal and control of the shape of the paddle section is difficult to achieve.

OBJECT OF THE INVENTION

It is an object of the invention to provide an improved rock bolt which includes a paddle section.

SUMMARY OF THE INVENTION

In accordance with the invention, there is provided a bolt including a paddle section formed by deforming a portion of the bolt through application of an eccentric shear force.

Preferably the paddle section includes two paddle portions projecting substantially parallel to a centre line bisecting the bolt, the portions being displaced to opposite sides of the bolt and the centre line.

Preferably, the bolt includes an expandable shell mounted to the paddle section, the shell including wedges adapted to be forced outwardly, by axial movement of the paddle portions therethrough, to lock the bolt against a wall of a bolt hole.

Preferably, a plurality of paddle sections are formed along the extent of the bolt.

In another aspect, there is provided a method of forming a bolt including applying an eccentric shear force to the bolt to deform a portion of the bolt laterally hereof and thereby produce a paddle section.

Preferably, the method includes applying an eccentric shear force from opposed sides of the bolt, parallel to and on opposite sides of a centre line bisecting the bolt.

BRIEF DESCRIPTION OF THE DRAWINGS

The invention is more fully described, by way of non-limiting example only, with reference to the accompanying drawings, in which.

DETAILED DESCRIPTION OF THE DRAWINGS

Figure 2:
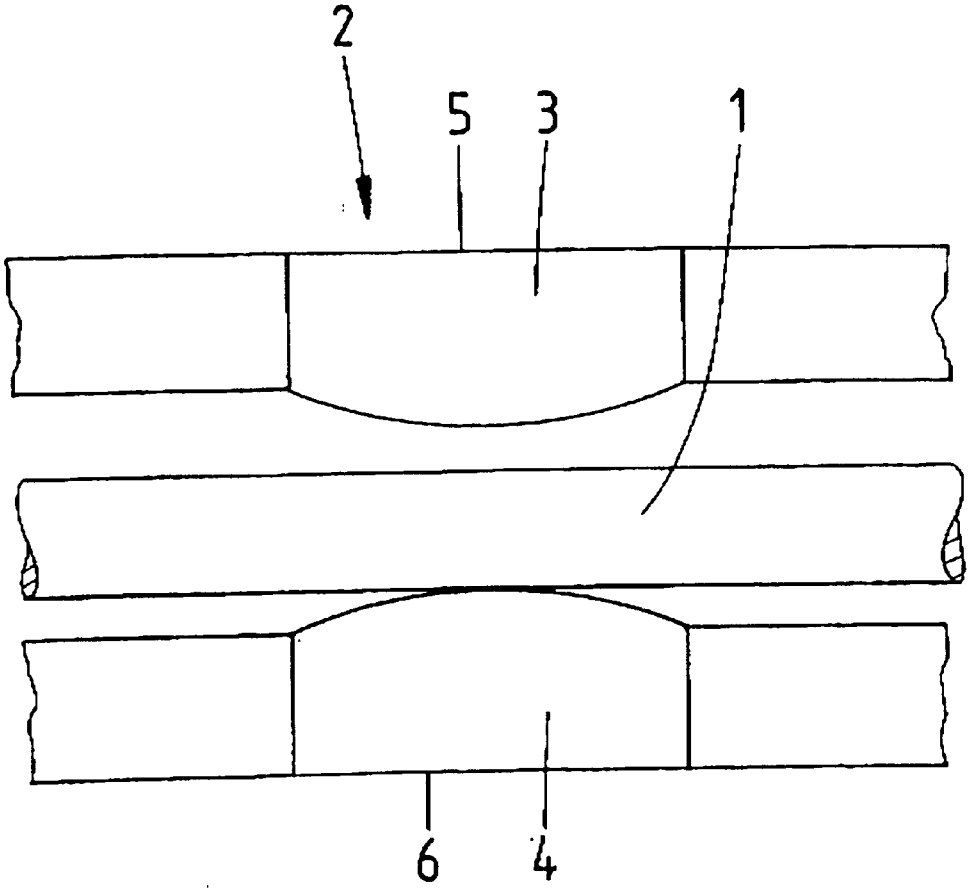
FIG. 2 is a side view of the press shown in FIG. 1.
Figure 1:
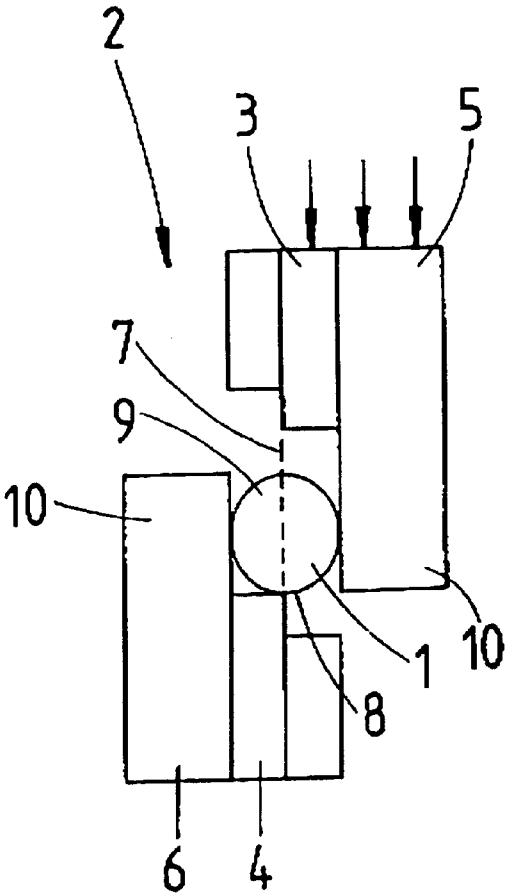
FIG. 1 is a diagrammatic cross sectional view of a press used to form a bolt of the invention.

Referring firstly to FIGS. 1 and 2, a bolt 1 is shown in a press 2, which comprises a pair of opposed blades 3, 4 mounted in respective tools 5, 6. The blades 3, 4 are laterally offset, to either side of a central line 7 which bisects the bolt 1. The blades 3, 4 are shown in FIG. 2 as having a convex profile but may be of any desired shape.

In operation, the bolt 1 is located between the blades and held in a centred position by stop components 10 of the tools 5, 6, which extend lengthwise of the bolt. The tools are then brought together so that the blades engage the bolt from opposed sides thereof, to either side of the central line 7. A shear force is then applied via the blades. A lower portion 8 on the lower right hand side of the bar, as viewed in FIG. 1, is deformed downwardly and an upper left hand portion 9 is deformed upwardly, to produce a paddle section in the bolt. The stop components 10 inhibit sideward deformation of the portions 8, 9, during application of the shear force.

Figure 3:
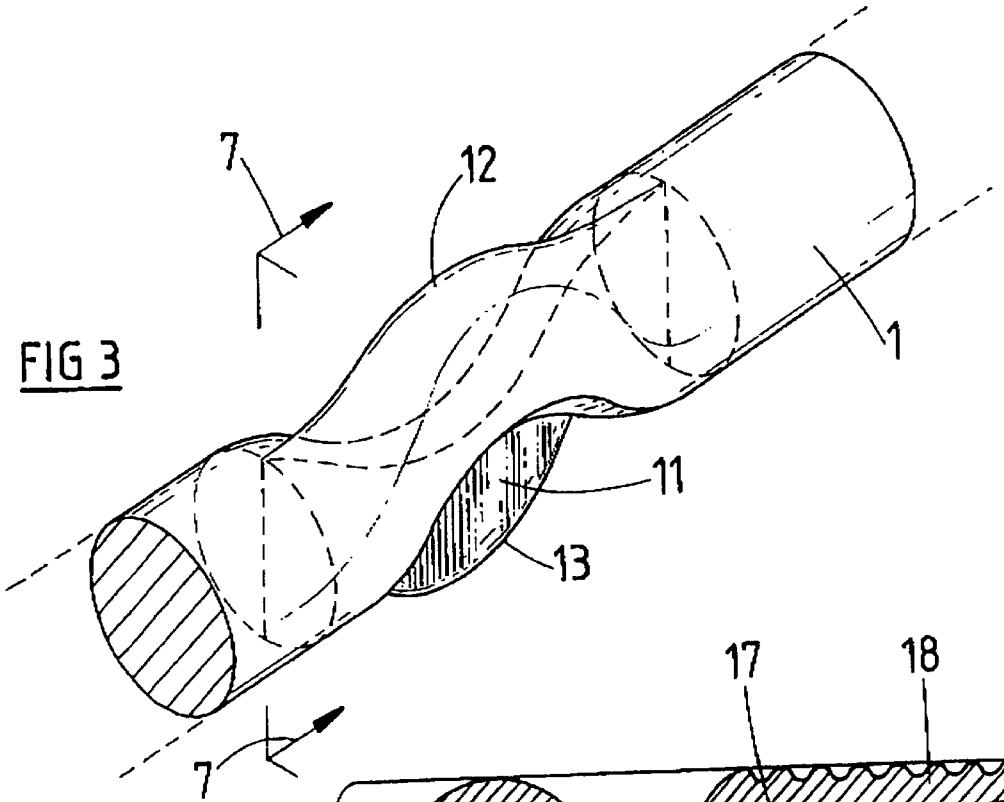
FIG. 3 is a perspective view of a bolt in accordance with the invention.

The resultant paddle section 11 is shown in FIG. 3 as including two paddle portions 12, 13 which are displaced laterally of the bar in the direction generally parallel to the centre line 7, with the portions 12, 13 arranged to opposite sides of the central line. The paddle portions, being displaced laterally of the bolt, render the paddle section suitable for mixing resin between the bolt and a wall of a hole, where the difference in diameter between the bolt and the hole wall would otherwise have been too large to obtain sufficient mixing of the resin by rotation of the bolt alone, without provision of the paddle section.

Figure 4:
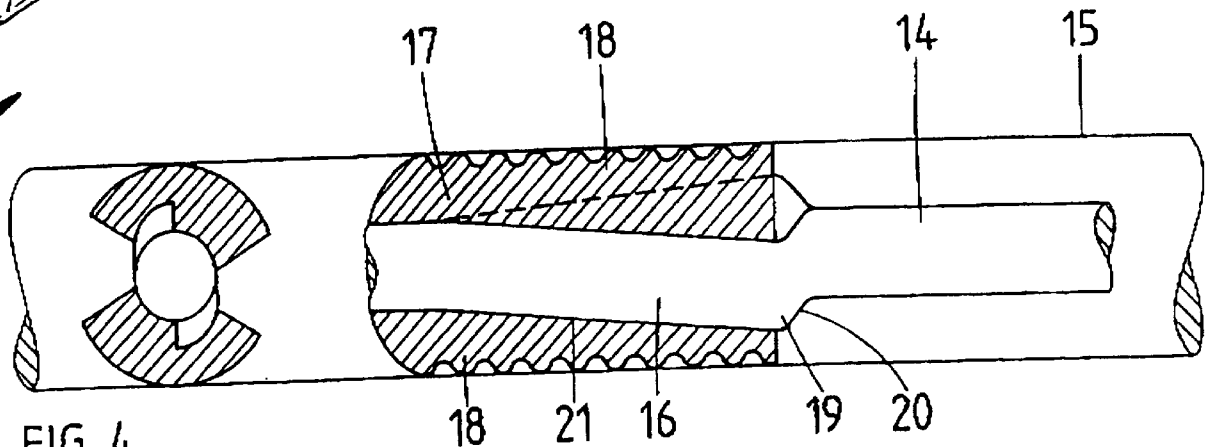
FIG. 4 is a diagrammatic side view of an alternative bolt, formed in accordance with the invention.

In FIG. 4, a bolt 14 is shown in a hole 15. The bolt includes an alternatively shaped paddle section 16, to which is mounted and expandable shell 17 with outwardly displaceable wedges 18 which are used to engage a wall of the hole for locating the bolt in the hole. The paddle section 16 includes a paddle portion 19 which is substantially displaced laterally of the bolt toward only one end 20 to provide a ramp section 21. The ramp section 21 may be utilised to engage with the uppermost wedge 18 of the shell 17 such that movement of the bolt 14 to the right, as shown, forces the wedge against the wall of the hole to lock the shell and thereby the bolt in place.

Figure 5:
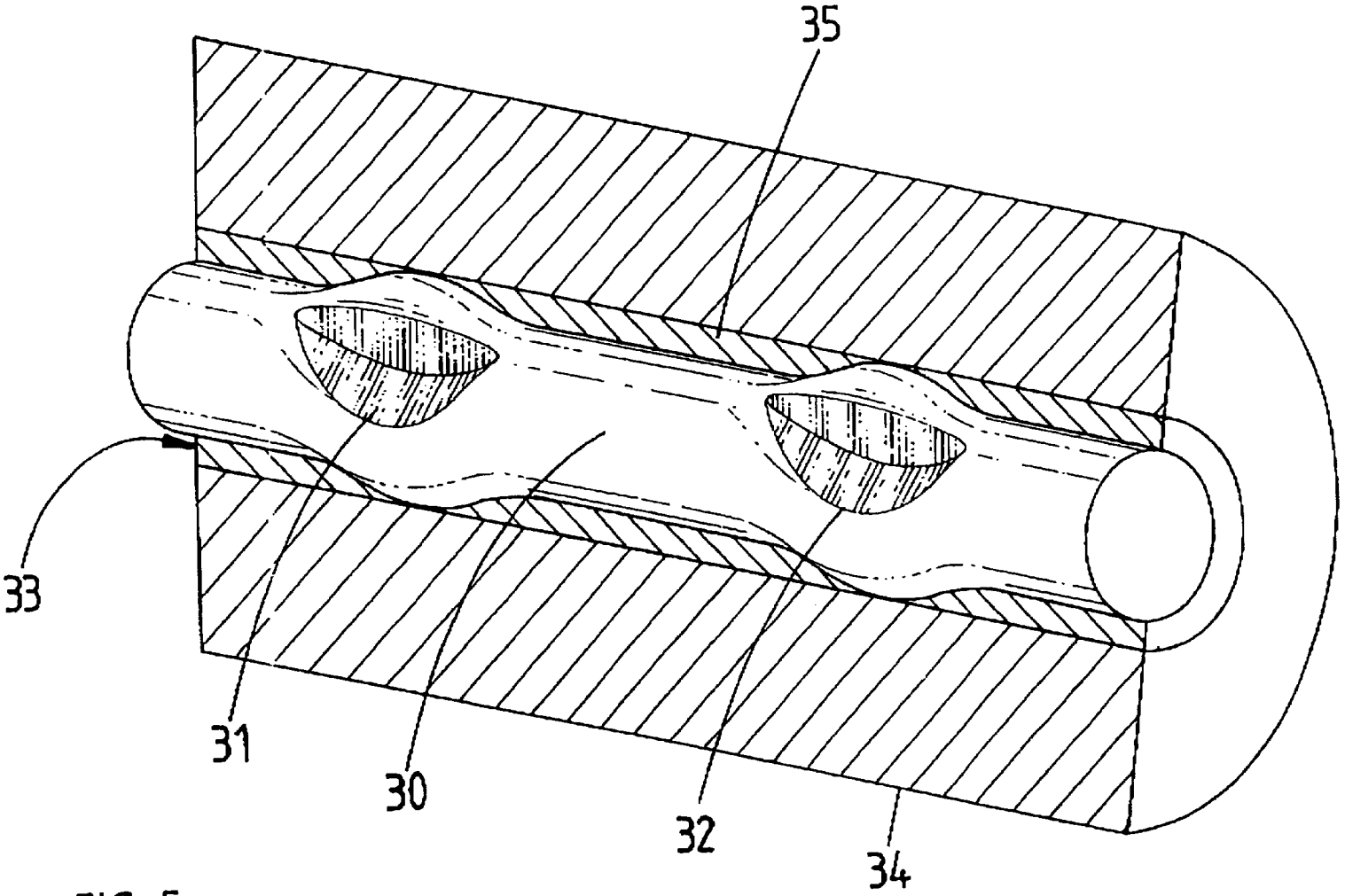
FIG. 5 is a diagrammatic perspective view of a bolt secured in a rock face.

FIG. 5 illustrates a bolt 30, formed in a similar fashion to the bolt 1, except with the provision of two paddle sections 31, 32 instead of a single section 11. The bolt is shown installed in a bolt hole 33 formed in a rock face. The bolt 30 is secured in the hole 33 with a resin 35, previously mixed by the paddle sections.

As may be appreciated from the above, the shape and configuration of the blades may be varied, as required and it is conceived possible that only one blade may be used to provide a paddle section with a single paddle portion. The invention also allows for a considerable degree of control over the shape and size of the paddle portion, through use of shear forces to form the paddle section, as opposed to a straight compressive force. Further, the paddle section of the bolt may be suitably configured to cooperate with an expandable shell for locating a bolt in a hole in a mine wall.

Many modifications and variations may be made to the above described bolt without departing from the spirit and scope of the invention as herein described.

What is claimed is:

1. A method of forming and installing a rock bolt, said method comprising the steps of:

a. plastically deforming a shank portion of the bolt by application of an eccentric shear force to form at least one paddle section, said paddle section protruding beyond the undeformed exterior of said shank portion prior to deformation;

b. inserting the plastically deformed bolt into a hole drilled in a rock body and having a diameter sufficient to receive the plastically deformed bolt with a clearance fit, said hole having previously had inserted therein a resin mixture;

c. rotating said bolt about its longitudinal axis to move said at least one paddle section through said resin mixture to mix the constituents thereof together; and d. allowing said resin mixture to harden in said hole and around said at least one paddle section.

2. A method as claimed in claim 1, wherein each paddle section includes two paddle portions projecting substantially parallel to a centre line bisecting the bolt, the portions being displaced to opposite sides of the bolt and the center line.

3. A method as claimed in claim 2, wherein the bolt includes an expandable shell mounted to a corresponding said paddle section, the shell including wedges adapted to be forced outwardly, by axial movement of the paddle portions therethrough, to lock the bolt against said hole.

4. A method as claimed in claim 1, wherein a plurality of paddle sections are formed along said shank portion.

5. A fastener installation comprising:

a rock bolt having a shank section comprising an exterior surface and extending along a longitudinal axis, said bolt having at least one paddle section, said at least one paddle section comprising a portion of said shank section that is plastically deformed beyond the exterior surface of the remainder of said shank section forming a surface in a plane bisecting said shank section through said longitudinal axis;

a hole drilled in a rock body, said hole having a diameter sized so as to receive said bolt with a clearance fit, such that said bolt may be rotated about said longitudinal axis without contacting the wall of said hole; and a resin mixture, said resin mixture contained in said hole to be cooperable with said at least one paddle section of said bolt.

* * * * *